United States Patent [19]

Gerszewski

[11] Patent Number: 4,918,891

[45] Date of Patent: Apr. 24, 1990

[54] PRECAST CONCRETE FOUNDATION ELEMENTS AND SYSTEM AND METHOD OF USING SAME

[75] Inventor: Mark Gerszewski, Norfolk, Va.

[73] Assignee: U.M.C., Inc., Virginia Beach, Va.

[21] Appl. No.: 339,842

[22] Filed: Apr. 18, 1989

Related U.S. Application Data

[63] Continuation-in-part of Ser. No. 49,060, May 12, 1987, abandoned.

[51] Int. Cl.[5] ..... E02D 27/10

[52] U.S. Cl. ..... 52/295; 52/125.4; 52/169.9; 52/299; 52/742

[58] Field of Search ..... 52/125.4, 125.5, 169.1, 52/169.9, 292–297, 608, 698, 742, 745, 143, 40, 146, 299; 404/43, 45

[56] References Cited

U.S. PATENT DOCUMENTS

| | | | |
|---|---|---|---|
| 1,447,942 | 3/1923 | Fitz Gerald | 52/294 |
| 1,746,668 | 2/1930 | McGarraugh | 52/299 |
| 2,022,551 | 11/1935 | Thompson | 72/0.5 |
| 2,802,632 | 8/1957 | Byers | 248/679 |
| 3,195,312 | 7/1965 | Rumsey, Jr. | 405/287 |
| 3,201,907 | 8/1965 | Henderson | 52/79.14 X |
| 3,216,163 | 11/1965 | Carew | 52/251 |
| 3,408,777 | 11/1968 | Gherelli | 5/73 X |
| 3,462,894 | 8/1969 | Svensson | 52/90 |
| 3,555,751 | 1/1971 | Thorgusen | 52/127.3 |
| 3,904,193 | 9/1975 | Patterson | 272/3 |
| 4,001,990 | 1/1977 | Chase et al. | 52/167 |
| 4,009,547 | 3/1977 | Hood | 52/294 |
| 4,051,642 | 10/1977 | Terry | 52/293 |
| 4,107,889 | 8/1978 | Gonsalves | 52/259 |
| 4,127,971 | 12/1978 | Rojo, Jr. | 52/79 |
| 4,202,145 | 5/1980 | Coulter et al. | 52/169.1 |
| 4,207,714 | 6/1980 | Mehls | 52/79.9 |
| 4,275,538 | 6/1981 | Bounds | 52/229 |
| 4,479,342 | 10/1984 | Eberle | 52/742 |
| 4,569,173 | 2/1986 | Hulquist | 52/293 |
| 4,614,460 | 9/1986 | Heyman | 405/195 |

FOREIGN PATENT DOCUMENTS

| | | | |
|---|---|---|---|
| 173074 | 4/1952 | Austria | 52/296 |
| 584732 | 2/1925 | France | 52/295 |
| 169134 | 10/1982 | Japan | 52/292 |
| 174540 | 10/1982 | Japan | 52/292 |
| 939649 | 6/1982 | U.S.S.R. | 52/292 |
| 1101522 | 7/1984 | U.S.S.R. | 52/292 |

OTHER PUBLICATIONS

Fibermesh–Concrete Engineering Data Report, F.E.D. Report No. 6.

*Primary Examiner*—David A. Scherbel
*Assistant Examiner*—Anthony W. Williams
*Attorney, Agent, or Firm*—Griffin, Branigan & Butler

[57] ABSTRACT

A one-piece footing/pier foundation element (10) comprises a round concrete disc-shaped footing (24) with an elongated pier (18) extending from one side thereof. An elongated embedded pier bolt (36) extending from a top surface of the pier is used for carrying the footing/pier element and for holding a girder (72) mounted on top of the pier. The footing includes on a bottom surface thereof a stabilizing element (16,64) for preventing the footing/pier from moving laterally when in position and to prevent undue settling. The footing includes elongated footing voids (40,58) parallel with the elongated pier positioned about the pier for receiving footing bolts (14) for holding angle irons (76) extending between two footings. A system and method for using these footings/pier foundation elements involves boring appropriately positioned holes in the earth, placing the footing/pier elements in those holes and supporting a building from beams extending between top surfaces of the piers and the footings.

14 Claims, 3 Drawing Sheets

PRECAST CONCRETE FOUNDATION ELEMENTS AND SYSTEM AND METHOD OF USING SAME

This application is a continuation-in-part application of U.S. application Ser. No. 49,060, filed May 12, 1987, which is now abandoned.

BACKGROUND OF THE INVENTION

This invention relates generally to prefabricated foundation footings for constructing buildings and more specifically to a particular prefabricated footing/pier and a system and method for using it.

It has long been recognized that houses, utility buildings and other structures should be erected upon a foundation rather than simply being placed directly on the earth, and most such foundations are made of poured concrete footings with a wall or piers of hollow concrete blocks set in place thereon. This kind of foundation is now standard in the building industry.

Typically, such foundations are constructed by first laying out the parameters of a foundation wall with batter boards, grade stakes, nails and string. Then a crawl space area is excavated, and continuous footing trenches are dug, leveled, and tamped. Reinforcing rods or elements are then placed in the trenches, and concrete is poured and allowed to set to form a footing for receiving the hollow concrete blocks.

The concrete blocks are then set by hand upon the poured footings, one at a time, using cement mortor as the leveling and bonding medium. Finally, the building is installed on a series of concrete block piers and is secured thereto by anyone of several methods. This process for foundation construction is labor intensive and calls for a number of different skills by the workmen. It is also subject to a number of construction errors, such as can occur when foreign materials, like pieces of wood, are utilized to initially support the reinforcing elements, and are then not removed before pouring the concrete.

There are, in fact, a number of disadvantages with this kind of foundation construction, including the following:

1. structural quality of a poured continuous footing is difficult to control on the job site because of failure to properly install reinforcement elements, earthen footing trench walls caving in before or during placement of the concrete and weather conditions such as heavy rains occuring before the concrete has been poured and sets. These conditions usually result in later differential settlement of the footings at points where their structural integrity is impaired, which can cause resultant damage to the concrete block piers and to the building structure resting on the footings. In the case of the block piers, the resulting damage can be in the form of continuous cracks in mortor joints or even ultimate block failure if the weight of the building is shifted and becomes improperly applied. The building itself can be damaged to a lesser or greater extent, ranging from wall cracks and non-alinged doors and windows to collapse of the whole building.

2. Because of the complexity of the construction, poured in placed footing and hollow concrete block foundations require careful coordination between a number of different workmen's skills, which skills may or may not always be available and, the practice of which in all cases requires many hours of increasingly expensive labor.

3. The construction of poured in placed footing and hollow concrete block foundations is especially dependent upon relatively lengthly periods of good weather, because of the time required for construction and the use of earth and trenches for the footings.

All of these disadvantages are heightened when working with the modular or prefabricated buildings of today, which arrive at a job site ready to be installed in functioning condition. The transport of these manufactured buildings is expensive and must be properly scheduled to achieve economically satisfactory results, but this scheduling is difficult to achieve in many instances because of the unanticipated delays often involved with normally poured footing and concrete block type foundations.

The need for better foundation construction methods has been recognized, and there have been attempts to provide improved foundations. One such effort is represented by U.S. Pat. No. 4,107,889, wherein precast concrete beams are installed upon poured-in-place piers utilizing hollow pedestals, reinforcement elements, and poured concrete for the actual installation. However, the basic problems with pouring concrete into earthen forms is present, and the workmen's skills required for construction are still extensive and the process lengthy.

U.S. Pat. No. 4,275,538 to Bounds describes a building foundation method and systems which include preformed footings and cast concrete beams which span the footings for supporting a building. However, the precast footings are somewhat unwieldy to grip and put into place, and their incorporation into a system is unduly complicated. Further, Bounds method is somewhat labor intensive in that it involves the hand digging of footing cavities, the pouring of concrete, and a number of other time consuming tasks.

There is, thus, still a need for improved prefabricated foundation elements and a method and system for use thereof to reduce the type and amount of skilled labor needed at a job site and which will produce significantly superior foundations of uniformly high quality at a lower cost than has been previously possible. It is an object of this invention to provide such prefabricated foundation elements and a method and system for using the same.

It is a further object of this invention to provide a prefabricated foundation element which provides both a foundaton footing and a pier but yet which is easy to transport, handle, and install for creating a foundation system.

It is also an object of this invention to provide a prefabricated foundation element which is inexpensive to both manufacture and to use.

SUMMARY

According to principles of this invention, a precast reinforced concrete footing/pier element includes a round, disc-shaped, footing and a substantially narrower elongated pier whose bottom end joins the footing at the center thereof and whose top end has the end of a bolt sticking thereout. The precast footing/pier is cast of one piece of concrete with reinforcing extending approximately the entire length of the pier down into the footing and substantially throughout the disc-shaped footing. In the preferred embodiment, the bolt extends down through the pier into the footing and is embedded in the concrete so that its top end can be gripped for manipulating the footing/pier for use in a foundation. There are elongated holes in the footing parallel with the pier and surrounding the pier for receiving a bolt to extend from a top surface of the footing. A stabilizing element is positioned on a bottom surface of the footing for engaging the earth thereunder and thereby preventing the footing/pier from moving laterally or unduly settling. In this respect, in one embodiment the stabilizing element is a spike for extending out of the bottom of the footing and in another embodiment the stabilizing element is a cavity for allowing earth to enter therein. In the case of the spike, in a sub-embodiment, the spike is a separate element which can be adhered to the bottom of the footing for allowing the footing/pier to be supported on a flat surface by its bottom during transportation. In one embodiment the pier has a rectangular cross section and in another embodiment it has a round cross section.

The system and method of using the footing/pier of this invention involves boring holes in the earth at positions at which the footing/piers are to be mounted, gripping the footing/piers by the bolt extending out of the top ends of the piers with a hoisting apparatus and manipulating the footing/piers into the respective holes so they are aligned one with the other for receiving spanning girders on the tops of the piers and for receiving spanning beams on the tops of the footings. A house's main structure is then built on the girders and a brick or stone facade for the house is built on the beams.

BRIEF DESCRIPTIONS OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 1:
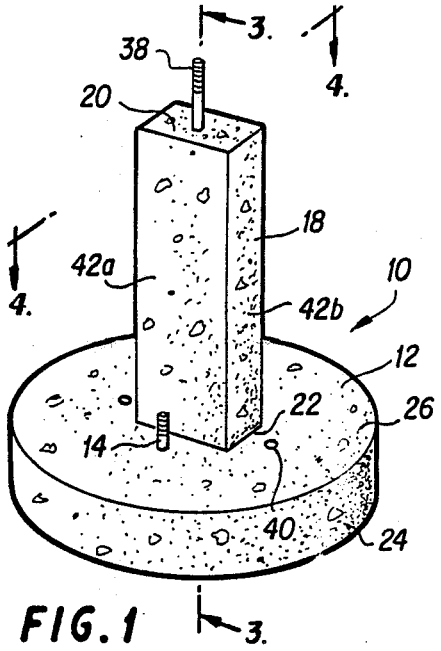
FIG. 1 is an isometric top view of a reinforced precast footing/pier element of this invention.
Figure 2:
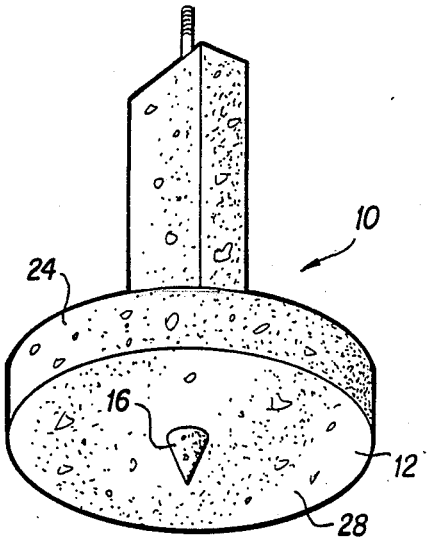
FIG. 2 is an isometric bottom view of the precast footing/pier element of FIG. 1.
Figure 3:
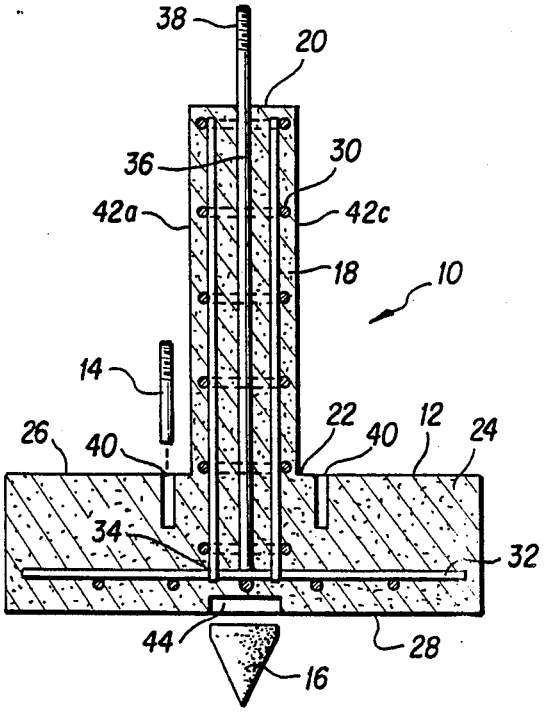
FIG. 3 is a cross-sectional, partially exploded, view taken on line 3—3 of FIG. 1 with a footing bolt and a footing spike being exploded therefrom to show that they are separate elements.
Figure 4:
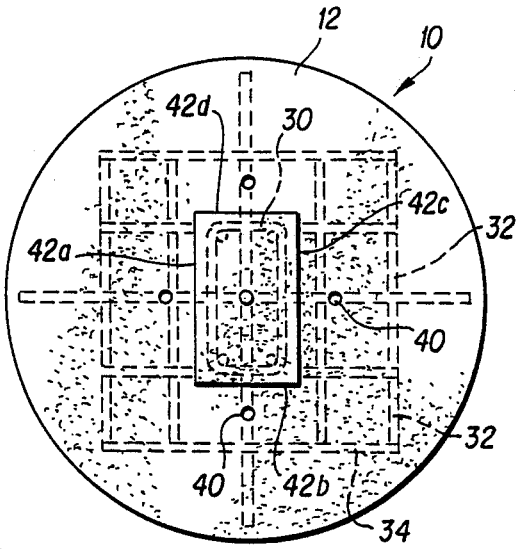
FIG. 4 is a sectional view taken on line 4—4 of FIG. 1 with reinforcing elements being shown in dashed lines.

Referring now to FIGS. 1 through 5, a footing/pier foundation element 10 is primarily a one-piece cast, reinforced concrete member 12 which includes all that is shown in FIGS. 1–3 except a footing bolt 14 and a footing spike 16. In this respect, the precast member 12 comprises an elongated rectangular pier 18 having a top surface 20 and a bottom end 22 and a substantially round, disc-shaped footing 24 having a top surface 26 and a bottom surface 28. In this regard, the elongated pier 18 and the disc-shaped footing 24 are precast as a single piece with reinforcing metal therein as is shown in FIGS. 3 and 4. With regard to the reinforcing metal, a tubularly arranged 4 in. ×4 in. wire mesh 30 extends substantially throughout the length of the pier 18, down into the disc-shaped footing 24 as can be seen in FIG. 3. The tubular arrangement of this wire mesh can be seen in FIG. 4. A grid 32 of No. 4, ½ inch, rebar 32 is embedded approximately 3 inches from the bottom surface 28 of the disc-shaped footing 24. In this respect, the various rebar shafts 32, 34 etc. are tied together at their intersections, and the wire mesh 30 is tied to the rebar grid 32 where they intersect at 34.

Extending the length of the pier 18, and sticking out the top 20 thereof and down into the footing 12, is a central pier bolt 36 with threads 38 at the top end thereof. The pier bolt 36 is embedded firmly in the precast concrete member 12 so that it can be gripped to manipulate the precast member 12. In this respect, in some embodiments the pier bolt 36 is attached to the rebar grid 32 at its bottom end. Since the pier polt 36 is centrally located, when the foundation element 10 is lifted by the top of the pier bolt 36 it dangles vertically thereunder in an approximate plumb attitude, thereby aiding in the proper positioning of the foundation element 10.

Figure 5:
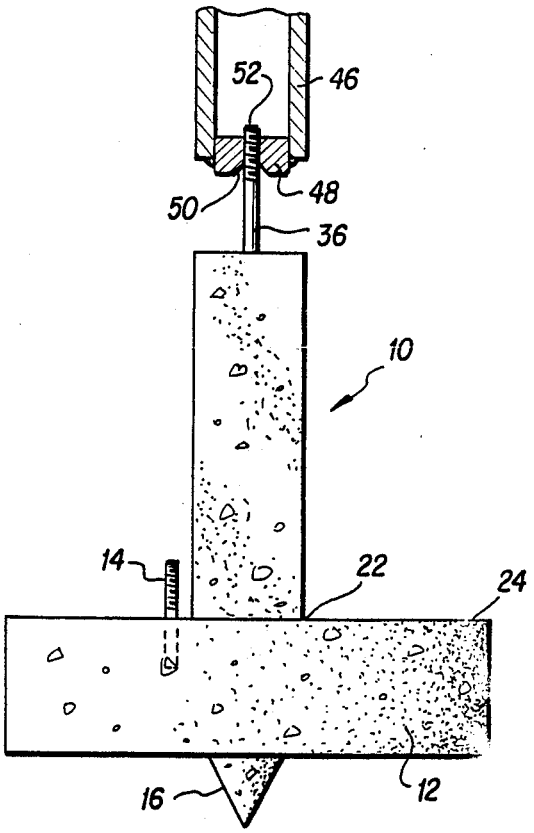
FIG. 5 is a side view of the footing/pier element of FIG. 1 being lifted by a grappling apparatus.

The footing bolt 14 is a separate member but is constructed to be securely mountable in elongated voids 40 which extend down into the footing 12 from the top side 26 thereof to be parallel with the elongated pier 18. Such bolts are commonly referred to as expansion bolts. A void 40 is located at each lateral side 42*a,b,c,d,* and is centered thereon. Thus, when the footing bolt 14 is firmly mounted in one of the voids 40 it is immediately adjacent one of the lateral sides 42*a–d* of the pier 18. Also separate from the precast member 12 is a concrete spike 16 which can be mounted in a spike cavity 44 on the bottom 28 of the footing 24. Normally, the footing spike 16 is not mounted on the footing 24 when the footing/pier foundation element 10 is being transported so that the element 10 can rest on the footing bottom surface 28 without damaging the spike 16. When the element 10 is ready to be installed, as will be described below, the spike 16 is adhered with an adhesive in the spike cavity 44 as the element is lifted by a grappling apparatus 46 (FIG. 5).

With regard to the grappling apparatus 46, this apparatus has mounted thereon a grappling element 48 which is somewhat like a nut but which has a conical opening 50 leading into a threaded bore. The conical opening 50 engages the top end 52 of the pier bolt 36 to lead it into the threaded bore. The grappling apparatus rotates the grappling element 48 onto the threads of the pier bolt 36 and thereafter the grappling apparatus 46 lifts upwardly to raise the footing/pier foundation element 10 from its supporting surface and mount it in a vertical attitude in a foundation position in the ground as will be described below.

Normal dimension ranges of the precast member 12 of FIGS. 1–5 are as follows:

| Member Measured | Dimension |
|---|---|
| Widths of long sides 42a & c of pier | 12 inches to 16 inches |
| Widths of short sides 42b & d of pier | 8 inches to 12 inches |
| Diameter of disc-shaped footing 24 | 20 in., 24 in., 30 in., 36 in., 42 in., 48 in. (per appln.) |
| Length of pier 18 (footing top surface 24 to pier top surface 20) | 20 in., 28 in., 36 in., and 44 in. (per appln.) |
| Height of the disc-shaped footing 24 (from bottom surface 28 to top surface 26) | 10 in., 12 in., 15 in. (per appln.) |
| Length of spike 16 beyond the bottom surface 28 | 8 in. to 12 in. |

With regard to these dimensions, it is noted that normal foundation piers are constructed of 8 in. ×16 in. blocks, however, because the precast member 12 is construced of solid reinforced concrete, the long sides 42*a* and 42*c* of the pier 18 may be reduced to 12 inches. Further, the lengths of the pier 18 above the top surface 26 of the footing 24 are at 8 inch intervals starting at 20 inches to correspond with 8 inch high blocks and a 4 inch cap which is normally placed on top of blocks.

Figure 6:
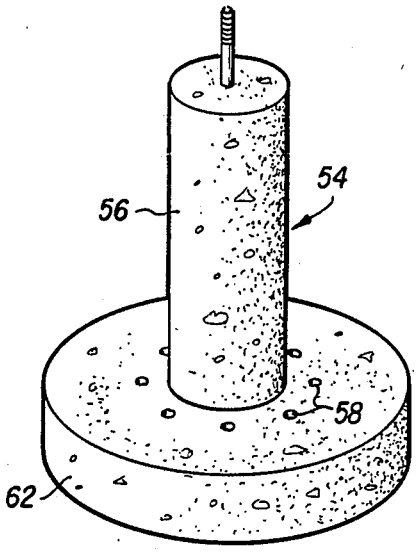
FIG. 6 is a top isometric view of an alternate embodiment of the precast footing/pier element of FIG. 1.
Figure 7:
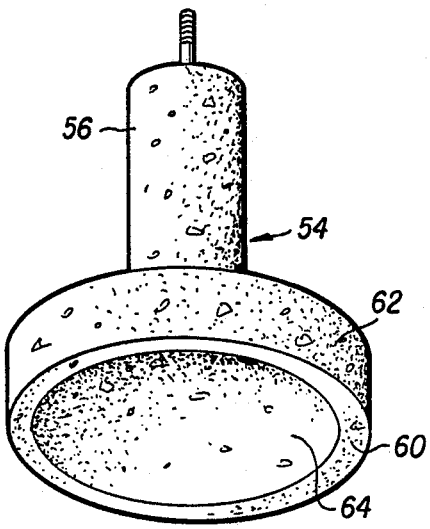
FIG. 7 is a bottom isometric view of the FIG. 6 embodiment.
Figure 8:
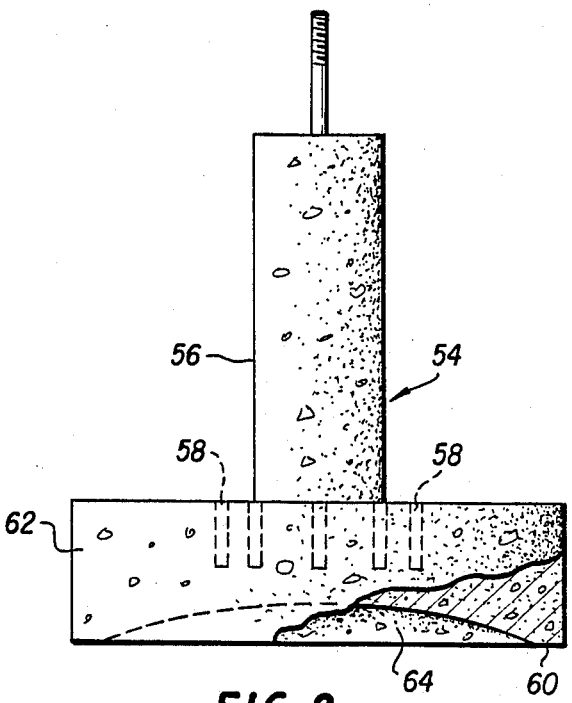
FIG. 8 is a side view of the FIGS. 6 and 7 embodiment showing footing-bolt voids and a stabilizing cavity being shown in dashed lines; and, FIG. 9 is an isometric, schematic, view illustrating a system and method of making a building using the precast footing/pier elements of FIG. 1.

Looking now at the precast member 54 of the FIGS. 6–8 embodiment, this precast member is substantially similar to the precast member 12 of the FIGS. 1–5 embodiment, with the exception, that an elongated pier 56 is round in cross section rather than rectangular, and in that there are more footing voids 58 completely surrounding the round pier 56. Also, rather than having a spike 16, a bottom surface 60 of the round disc-shaped footing 62 is concaved to form a cavity 64.

The round pier 56 has a 12 inch to 15 inch diameter but in all other respects, the precast member 54 has the same dimensions as were given earlier for the FIGS. 1–5 embodiment. Also, the reinforcing arrangement is the same.

By having more footing voids 58, one need not be as careful in positioning the precast member 54 for preparing a foundation as will be described below. The footing voids 58, of course, receive footing bolts 14 in the same manner as is depicted in FIG. 3.

The cavity 64 allows soil to extend up into the footing 62, thereby preventing lateral movement and undue settling of the precast member 54 once it is placed in position to form part of a foundation. The FIGS. 6–8 embodiment is better for wet soil than is the FIGS. 1–5 embodiment which uses a spike 16. The spike 16 helps to displace and compact soil when the precast member 12 is being positioned, while wet soil moves easily into the cavity 64. One advantage of using a cavity 64 rather than a spike 16 is that the bottom surface 60 of the footing 62 can be used for supporting the precast member 54 during transportion and the precast member 54 can thereafter be placed in a foundation without the necessity of adhering a spike or some other member to the bottom surface 60.

It should be understood that various elements of the FIGS. 1–5 embodiment can be exchanged with corresponding elements of the FIGS. 6–8 embodiment. For example, the concaved-bottom cavity 64 could be used with the rectangular pier and the circular pier 56 could be used with a footing having a spike. Similarly, voids 40 and 58 could be interchanged between the embodiments.

Figure 9:
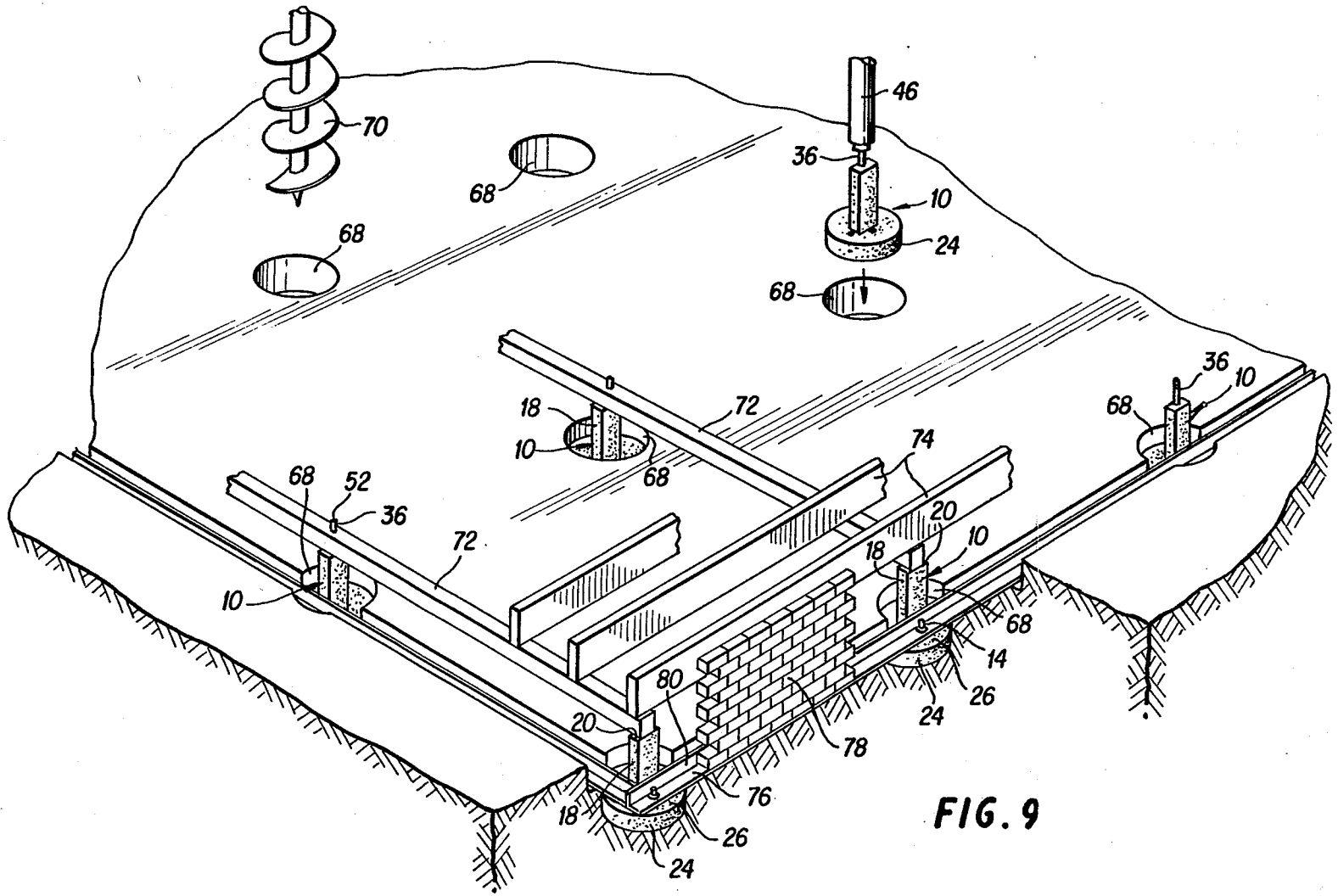

Looking now at a foundation system and method employing the footing/pier foundation elements of either the FIGS. 1–5 embodiment or the FIGS. 6–8 embodiment, with reference to FIG. 9, a plurality of footing/pier foundation elements 66 are transported to a building site in a truck resting on bottom surfaces of the disc-like footings. The proper ground locations to place the foundation elements 10 on approximately 6 to 10 foot centers are determined and, at those points, holes 68 are bored in the ground to a proper depth using an auger 70 which makes holes 68 having a diameter slightly larger than the diameter of the disc-shaped footings 24. To achieve required soil bearing capacities it may be necessary to prepare the soil for receiving the piers. This is done by boring the holes 68 deeper than required and then backfilling them with sand or engineered fill and tamping the backfill down. The grapple hoisting apparatus 46 is then engaged with each of the pier bolts 36 of the footing/pier foundation elements 10 and they are, one after the other, lifted from a truck and lowered into a bored hole 68. The foundation elements 10 are plumbed and aligned using proper measuring instruments. Once the foundation elements are properly positioned, girders 72 are placed on the top surfaces 20 of aligned piers 18 with top ends 52 of the pier bolts 36 extending through holes in the girders 72 to hold the girders in position. The girders can be tightly held in these positions by engaging nuts with the threads on the ends of the pier bolts 36 and tightening these nuts onto the tops of the girder 72, although this is not always necessary. Thereafter, wooden joists 74 are mounted on the girders and a building is raised thereon.

In addition, 4×4 or 4×6, ⅜ inch, rust-treated, angle irons 76 are placed to span the top surfaces 26 of the footings 24 as is depicted in FIG. 9 with footing bolts 14 extending through holes in horizontal legs of the respective angle irons 76. Again, nuts are tightened onto the footing bolts 14 to hold these angle irons 76 tightly in position. In some cases it will be necessary to dig a trench 77 between foundation elements to accommodate the angle irons 76. However, the digging of a trench 77 can be avoided by placing solid precast concrete blocks (not shown) with holes therethrough on the top surfaces 26 of the footings 24 with footing bolts 14 passing therethrough. The angle irons 76 are then placed on the blocks and the footing bolts 14 are used to attach them thereon. Such blocks can be shaped to fit snugly against the piers 18. Thus, these blocks raise the angle irons 76 above ground level so that it is not necessary to dig a trench. Thereafter, a brick facade 78 is built on the angle irons 76 immediately adjacent the building to cover the building faces if desired. It should be understood that the angle irons 76 could be oriented so that vertical legs 80 thereof are not immediately adjacent piers 18 as is depicted, but rather, are spaced away from the piers so that they are on the outside surface of the brick facade 78 to provide lateral support for the brick facade 78.

It will be appreciated by those of ordinary skill in the art that the footing/pier foundation elements described herein are relatively easy and economical to manufacture, but yet provide vast improvements to foundation systems, both in the construction thereof and in the use thereof. These elements can be easily transported and manipulated into position. They are relativley light weight for foundation elements, but yet are extremely sturdy to provide firm foundations for buildings.

While the invention has been particularly shown and described with reference to a preferred embodiments, it will be understood by those skilled in the art that various changes in form and detail may be made therein without departing from the spirit and scope of the invention. In this regard, the dimensions can be varied quite a bit, however, in order to achieve a light-weight, yet a firm foundation element, it is necessary that the cross section dimensions of piers 18 be substantially less than the diameters of the footings 24 and in most cases the longest lateral dimensions of the piers will be less than half the diameters of the footings. Similarly, it is important that the lengths, or heights, of the piers be substantially longer than the height of the footings. Again, this is to provide a firm lateral support for a light-weight, yet tall, foundation element. Also, wooden and/or metal shim plates can be used to compensate for height differences between piers, i.e. metal shims could be placed between the top surfaces 26 of footings and the angle irons 76 and wooden shims could be placed on top of the piers 18 and the undersides of girders. In one embodiment the footing 24 has a lateral dimension of 24 inches and could have a lateral dimension as small as 20 inches for very small houses. The footings 24 can be rectangualr in which case bored holes 68 must have diameters as great as diagonal lines between corners of the rectangles.

Further, in addition to a pier with a single bolt extending down into the footing, an additional pier reinforcing plan is required for piers supporting greater loads. For example, in one embodiment there are five reinforcement bars extending the length of the pier, down into the footing. Each of four bars are located near a corner of the pier (or to form a square for a circular pier) and they are tied to each other with bars bent into rectangular or circular shapes positioned at 8 inch intervals along the height of the pier. These bars are No. 4, ½ inch rebar. 4×4 wire mesh is still positioned about the perimeter of the piers as previously described.

In another embodiment, the precast member 12 is not reinforced with localized metallic wire mesh 30 as is shown in FIGS. 3 and 4 but rather is reinforced with small synthetic fibers spread throughout the precast member 12. One such product is sold under the trademark FIBERMESH micro-reinforcement system for concrete by Fibermesh Co. of Chattanooga, Tennessee. The product is a collated fibrillated polypropylene olefin fiber in small bundles that unravel when added to concrete mix.

In one embodiment the angled members 76 are constructed of reinforced concrete rather than of steel. Such a construction has the benefit that the angled members 76 will not rust and will therefore be more durable. Another possible benefit of using reinforced concrete angled members is that they will provide a more solid flooring for two story layers of brick to be thereby supported.

In yet another embodiment, elongated voids 40 are not molded into the precast member 12 but rather are drilled therein at a worksite. Further, in one embodiment, such holes are drilled through an upstanding leg of angled member 76 into sides of piers 18 rather than into the tops of the footings 24. In this case, bolts ar placed through the upstanding leg of the angled member into the piers to hold the angled member to the piers.

In a specific embodiment bricks placed on the angled members 76 are first preassembled into panels. The bricks can be very thin veneers, mounted on sheets of concrete to from such panels. In one arrangement the panels are formed by molding sheets of concrete to have a brick-shaped outer surface, colored in the manner of bricks and morter. The panels have lengths to extend between piers of adjacent footing/pier foundation elements, thus, most such panels would be 8 feet long.

Still further, it is also possible to use the top surfaces 26 of the footings 24 and the angle iron 76 as portions of a form for pouring a concrete slab beside a house when appropriate.

It should be understood that as used herein the word house includes buildings for sheltering people.

The embodiments of the invention in which an exclusive property or privilege are claimed are defined as follows:

1. A precast one-piece foundation element to be constructed in a factory and transported to a construction site for constructing houses said one piece foundation element comprising:

a concrete, broad, flat-shaped footing having a breadth in all directions of a plane which is greater than twice the thickness thereof, said breadth in said all directions of said plane being around 20 inches or greater, said broad, flat-shaped footing having a broad top side and a broad bottom side;

cast together, as one piece, with said broad, flat-shaped footing on the top side thereof, an elongated concrete pier having a bottom end and a top end and having a substantially greater length dimension than a greatest lateral dimension thereof, said pier extending in elongation perpendicularly away from a central portion of said top side of said footing at the bottom end of said pier, the greatest lateral dimension of said pier being smaller than half the breadth of said footing;

pier reinforcing embedded in and extending substantially throughout said concrete pier into said concrete footing so as to bridge said concrete pier and footing and thereby reinforce a strength with which these two members are bonded one to the other;

footing reinforcing embedded in and cast with said footing, said footing reinforcing extending in said footing laterally beyond said lateral surfaces of said elongated concrete pier;

a bolt, cast with, and thereby embedded in, said pier and extending from the top end thereof, said bolt being sufficiently embedded in said pier so as to allow the foundation element to be lifted and moved about by engaging the bolt only;

whereby a portion of a house foundation can be formed by boring a round hole in the ground of a depth less than a combined footing thickness and pier length and of a breadth greater than a greatest footing breadth, and then placing said precast foundation element therein with the top end of said pier extending above ground for forming a platform on which said house can be built.

2. A precast foundation element as in claim 1 wherein said bolt extends the length of said pier into said footing.

3. A precast foundation element as in claim 1 wherein there are elongated voids in the footing about said pier and extending perpendicular to said elongated pier and wherein is further included a separate footing bolt which can be mounted in any one of said footing voids for extending a threaded end out of the top surface of said footing.

4. A precast foundation element as in claim 3 wherein said pier is rectangulr in cross section and there is a footing void located on each side of said pier.

5. A precast foundation element as in claim 4 wherein the pier is round in cross section and there are more than four footing voids located in said footing about said pier.

6. A precast foundation element as in claim 1 wherein a stabilizing means is mounted on the bottom side of said footing for engaging the earth and preventing lateral movement and settling of said footing/pier element.

7. A precast foundation element as in claim 6 wherein said stabilizing means is a spike which is adhered to the bottom side of said footing and extends downwardly therefrom.

8. A precast foundation element as in claim 7 wherein said spike is a separate piece from said footing and is adhered thereto.

9. A precast foundation element as in claim 7 wherein said stabilizing means is a cavity formed by casting the bottom side of said footing to be concave.

10. A foundation system for a house comprised of a plurality of precast one-piece foundation elements with each element comprising:

a concrete, broad flat-shaped footing having a breadth and a thickness, said breadth in all directions of a plane being greater than twice the thickness, said breadth in said all directions of said plane being around 20 inches or greater, said footing having a broad top side and a broad bottom side;

cast together, as one piece, with said footing, on the top side thereof, an elongated concrete pier having a bottom end and a top end and having a substantially greater length dimension than a greatest lateral dimension thereof said pier extending in elongation perpendicularly away from a central portion of said footing at the bottom end of said pier, the greatest lateral dimension of said pier being smaller than half the breadth of said footing;

pier reinforcing embedded in and extending throughout said concrete pier into said concerete footing so as to bridge said concrete pier and footing and thereby reinforce a strength with which these members are bonded one to the other;

footing reinforcing embedded in and cast with said footing, said footing reinforcing extending in said footing laterally beyond said side surfaces of said elongated concrete pier;

a bolt, cast with, and thereby embedded in, each of said piers and extending from the top end thereof, said bolt being sufficiently attached to said pier so as to allow the foundation element to be lifted by engaging only the bolt;

said foundation system comprised of said plurality of precast one-piece foundation elements having said pier elements mounted in holes in the earth, aligned and plummed one to the other, so as to support beams and girders which span top surfaces of the piers and top surfaces of the footings for respectively supporting the framework of a house and the facade of the house.

11. A foundation system as in claim 10 wherein there are elongated voids in the footings about each of said piers and extending perpendicular to said elongated pier and wherein is further included a separate footing bolt for each footing/pier element which can be mounted in any one of said footing voids for extending a threaded end out of the top surface of said footing.

12. A foundation system as in claim 11 wherein each of the piers is round in cross section and there are more than four footing voids located in each of said footings about its respective pier.

13. A foundation system as in claim 10 wherein piers are round in cross section and there are more than four footing voids located in each of said footings about its respective pier.

14. A method of constructing house foundations comprising the steps of:

boring circular holes with an auger device in the ground to a predetermined level;

inserting into each of said circular holes a precast, one-piece, reinforced concrete foundation element including:

a footing having a breadth and a thickness, said breadth in all directions of a plane being greater than twice the thickness thereof, said breadth in all directions of said plane being around 20 inches or greater, said footing having a broad top side and a broad bottom side;

cast together, as one piece, with said footing, on the top side thereof, an elongated concrete pier having a bottom end and a top end, and having a substantially greater length dimension than a greatest lateral dimension thereof said pier extending in elongation perpendicularly away from a central portion of said footing at the bottom end of said pier, the greatest lateral dimension of said pier being smaller than half the breadth of said footing;

pier reinforcing embedded in and extending throughout said concrete pier into said concrete footing so as to bridge said concrete pier and footing and thereby reinforce a strength with which these members are bonded one to the other;

footing reinforcing embedded in and cast with said footing, said footing reinforcing extending in said footing laterally beyond a side surface of said elongated concrete pier; and, a bolt, cast with, and thereby embedded in, said pier and extending from the top end thereof, said bolt being sufficiently embedded in said pier so as to allow the foundation element to be lifted by engaging only the bolt, said inserting step including the lifting of said foundation element into said circular hole by engagement of a lifting tool with said bolt;

aligning and plumbing said foundation elements one to the other;

spanning beams from top surfaces of the piers and the footings of adjacent single cast reinforced concrete pieces on which are respectively supported the framework and facade of a house.

* * * * *